US005642034A

United States Patent [19]

Amano

[11] Patent Number: 5,642,034

[45] Date of Patent: Jun. 24, 1997

[54] REGULATED POWER SUPPLY CIRCUIT PERMITTING AN ADJUSTMENT OF OUTPUT CURRENT WHEN THE OUTPUT THEREOF IS GROUNDED

[75] Inventor: Nobutaka Amano, Tokyo, Japan

[73] Assignee: NEC Corporation, Tokyo, Japan

[21] Appl. No.: 361,217

[22] Filed: Dec. 21, 1994

[30] Foreign Application Priority Data

Dec. 24, 1993 [JP] Japan ..... 5-326679

[51] Int. Cl.[6] ..... G05F 1/573

[52] U.S. Cl. ..... 323/277; 323/275

[58] Field of Search ..... 323/273, 275, 323/276, 277, 279

[56] References Cited

U.S. PATENT DOCUMENTS

| | | | |
|---|---|---|---|
| 3,988,643 | 10/1976 | Morris | 323/277 |
| 4,278,930 | 7/1981 | Rogers | 323/277 |
| 4,442,397 | 4/1984 | Ishikawa et al. | 323/275 |
| 4,862,057 | 8/1989 | Contartese et al. | 323/277 |
| 5,041,777 | 8/1991 | Riedger | 323/277 |
| 5,191,278 | 3/1993 | Carpenter | 323/275 |
| 5,491,401 | 2/1996 | Inoue et al. | 323/273 |

FOREIGN PATENT DOCUMENTS

| | | | |
|---|---|---|---|
| 4-295222 | 10/1992 | Japan | H02H 3/87 |

*Primary Examiner*—Jeffrey L. Sterrett
*Attorney, Agent, or Firm*—Foley & Lardner

[57] ABSTRACT

In a regulated power supply circuit, a "J characteristic curve" is obtained between an output current and an output voltage. Moreover, the output current is minimized in a grounded state in which the output terminal is grounded to minimize heat dissipation so as to facilitate circuit integration. Between the input and output terminals, there are connected an output-stage transistor and a current sense resistor in series. A voltage sense circuit senses voltage between an output terminal of the transistor and a ground terminal. The current sense circuit senses the output current by the current sense resistor. The transistor has a base terminal connected to output terminals of the voltage and current sense circuits, respectively. In this configuration, when the output terminal is grounded, the output current is set independently of a current value sensed at occurrence of an excess current. This consequently lowers the power consumption of the regulated voltage circuit in the grounded state.

3 Claims, 5 Drawing Sheets

REGULATED POWER SUPPLY CIRCUIT PERMITTING AN ADJUSTMENT OF OUTPUT CURRENT WHEN THE OUTPUT THEREOF IS GROUNDED

BACKGROUND OF THE INVENTION

The present invention relates to a regulated power supply circuit, and in particular, to a regulated power supply circuit having an excess current protection circuit.

DESCRIPTION OF THE RELATED ART

Conventionally, as can be seen from FIG. 1 showing a regulated power supply circuit of this kind, a current sense resistor $R_{1a}$ and an output control transistor $T_{14}$ are connected between an emitter terminal of a transistor $T_{11}$ in an output stage and an output terminal 115. In this circuit, when an excess current flows through the transistor $T_{11}$, a voltage drop due to the resistor, $R_{1a}$ is increased such that when the voltage drop exceeds $V_{BE}$, the output control transistor $T_{14}$ is turned on to reduce a base current of the transistor $T_{11}$, thereby achieving a function to minimize the current flowing through the transistor $T_{11}$. As shown in a graph of FIG. 2, according to a characteristic curve representing a relation ship between an output current $I_o$ and an output voltage Vout of the circuit shown in FIG. 1, the output current $I_o$ is limited to an excess current sense point $I_{oL}$.

Furthermore, according to another example of the prior art, there has been a constant-voltage power source circuit having a characteristic related to an output current $I_o$ and an output voltage Vout as shown in FIG. 3.

In contrast thereto, in accordance with a circuit configuration described in the Japanese Patent Laid-Open Publication Hei-4-295222, there are disposed an external resistor 133, a constant-current source 134, a comparator 135, and a differential amplifier 136 to easily adjust the excess current sense point $I_{oL}$. When the value of $I_{oL}$ is set to the necessary minimum value, it is possible to suppress generation of heat at occurrence of an excess current. In this case, $I_{oL}$ is set in accordance with the product between a current value Ib of the current source 134 and a resistance value $R_{1b}$ of the resistor 133.

However, according to the conventional example, in a grounded state of the circuit, namely, for $V_{out}$=0 volt (v) power consumption PD of the transistor 117 is expressed as $V_{1n} \times I_{oL}$. Assume $V_{1n}$=10 volt and $I_{oL}$=1 ampere (A). Then, $P_D$=10 V×1 A=10 watt. Namely, a considerably large amount of heat is generated. This may possibly leads to destruction of the transistor 117. Moreover, according to the conventional example associated with the characteristic of FIG. 3, when the circuit is in the grounded state of $V_{out}$=0 V, the output current $I_o$ becomes zero ampere. Consequently, when $V_{1n}$ is inputted to the circuit, the constant-voltage circuit cannot be activated. In addition, the prior art of FIG. 4 is attended with a problem that the characteristics respectively of the output voltage and the output current cannot be independently adjusted.

SUMMARY OF THE INVENTION

It is therefore an object of the present invention to provide a regulated power supply circuit capable of solving the problems above.

To achieve the above object, in accordance with the present invention, there is provided a regulated power supply circuit which permits an adjustment of output current in a case when an output terminal of the circuit is grounded. The regulated power supply circuit includes a current control portion, disposed between an input terminal of the circuit and the output terminal and provided with two control input terminals, for controlling a current flowing through the input and output terminals of the circuit; current sense portion, inserted between a downstream end of the current control portion and the output terminal, for sensing the current and supplying a resultant signal to a first one of the two control terminals; and voltage sense portion for comparing a voltage between the output terminal of the circuit and a ground potential (GND) with a reference voltage and supplying an error signal to a second one of the two control input terminals. The current sense portion includes a comparator for sensing the current as a voltage applied to input terminals thereof. The circuit further comprises a current source for causing a current to flow through a circuit including one of the input terminals of the comparator so that the potential difference between the input terminals of the comparator does not become zero even when the output current of the regulated power supply circuit is zero.

Alternatively, the comparator may include a bias circuit for providing the input terminals of the current sense portion with a bias voltage so that the potential difference between the input terminals of the comparator does not become zero even when the output current of the regulated power supply circuit is zero.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 5:
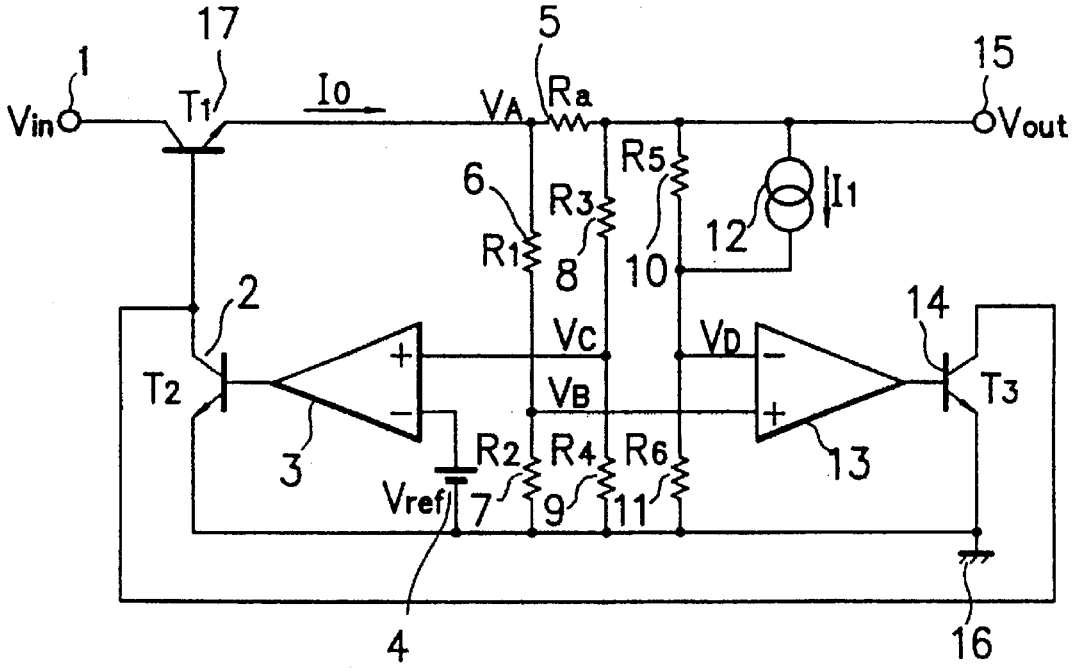
FIG. 5 is a schematic diagram showing the configuration of an embodiment of a regulated power supply circuit in accordance with the present invention.

In the regulated power source circuit of FIG. 5, an input terminal $V_{1n}$ is connected to a collector of an output-stage transistor 17. The transistor 17 has an emitter terminal linked with a first terminal of a current sense resistor 5. The resistor 5 has a second terminal connected in series to an output terminal 15 of the power source circuit.

Between the first terminal of the resistor 5 and a ground terminal GND 16, there are connected two resistors $R_1$ and $R_2$ in series. Between the second terminal of the resistor 5 and a ground terminal GND 16, there are respectively disposed series connections of two resistors $R_3$ and $R_4$ as well as two resistors $R_5$ and $R_6$.

Between a base terminal of the transistor 17 and GND 16, a first output control transistor 2 and a second output control transistor 14 are arranged in parallel in an emitter follower configuration. The transistor 2 has a base terminal connected to an output terminal of an error amplifier 3, and the transistor 14 has a base terminal linked with an output terminal of a comparator 13.

The amplifier 3 has a plus (+) input terminal connected to a connection point between the series registers $R_3$ and $R_4$. A voltage $V_{ref}$ of a reference voltage source 4 is applied between a minus (−) terminal of the amplifier 3 and GND 16.

Moreover, the comparator 13 has a plus (+) input terminal connected to a linkage point between the series registers $R_1$ and $R_2$. The comparator 13 has a minus (−) input terminal linked with a connection point between the series registers $R_5$ and $R_2$. Furthermore, a constant voltage source 12 is also coupled with a connection point between the series registers $R_5$ and $R_6$.

In operation of the regulated power supply circuit, the output voltage $V_{out}$ is divided by two registers 8 and 9 to compare an obtained voltage $V_c$ with the voltage $V_{ref}$ of the reference voltage source 4 by the error amplifier 3. Resultantly, the first control transistor 2 (to be abbreviated as $T_2$ herebelow) is controlled by an output from the amplifier 3, and the transistor 17 (to be abbreviated as $T_1$ herebelow) is controlled by a collector of $T_2$, thereby regulating the output voltage $V_{out}$ from the power supply circuit. The voltage $V_{out}$ is expressed as follows.

$$V_{out}=(R_3+R_4)/R_4\times V_{ref} \quad (1)$$

A voltage developed across the end terminals of the current sense resistor 5 (to be abbreviated as Ra herebelow) is divided by registers to conduct comparison between the resultant voltages $V_B$ and $V_D$ by the comparator 13. When an output current $I_o$ from $T_1$ is increased such that $V_B$ exceeds $V_D$, the output from the comparator 13 is set to a high level and the control transistor 14 (to be abbreviated as $T_3$ herebelow) is turned on to decrease the base current of $T_1$, thereby reducing the output current $I_o$.

The output current $I_o$ when $T_3$ is turned on indicates the excess current sense point. The sense point $I_{oL}$ is expressed as follows.

$$I_{oL}=\{V_H\times(R_1+R_2)/R_2-V_B\times(R_5+R_6)/R_6\}/Ra \quad (2)$$

Subsequently, when the output terminal 15 is grounded ($V_{out}$=0 V), the voltage $V_D$ at the inversion input terminal of the comparator 13 becomes $I_1\times R_5/R_6$. Since the comparator 13 operates to equalize $V_D$ to the voltage $V_B$ at the non-inversion input terminal of the comparator 13, there is attained a relationship as follows.

$$V_B=V_D=I_1\times R_5//R_6$$

In this situation, at the terminal on the opposite side of the output terminal 15 of the current sense resistor Ra, there is developed a terminal voltage $V_A$ as $$V_A=V_D\times(R_1+R_2)/R_2,$$

and hence $$V_A=I_1\times R_5//R_6\times(R_1+R_2)/R_2, \quad (3)$$

is derived.

In consequence, when the circuit is in the grounded state, an output current Is flows therethrough as follows.

$$I_s=V_A/Ra=\{I_1\times R_5//R^6\times(R_1+R_2)/R_2\}Ra \quad (4)$$

This implies that the output current $I_B$ is decided by $R_a$, $R_1$, $R_2$, $R_5$, $R_6$, and $I_1$.

In this case, between the output voltage $V_{out}$ and the output current $I_o$, there is obtained a characteristic curve indicating a so-called J characteristic.

Subsequently, description will be given of a second embodiment of a regulated power supply circuit in accordance with the present invention. This embodiment is attained by removing the constant-current source 12 from the circuit structure of FIG. 5 and then applying an offset voltage 18 to the input terminal of the comparator 13. The output current at the grounded state is as follows.

$$I_s=V_A/Ra=\{V_{os}\times(R_1+R_2)/R_2\}Ra \quad (5)$$

Figure 8:
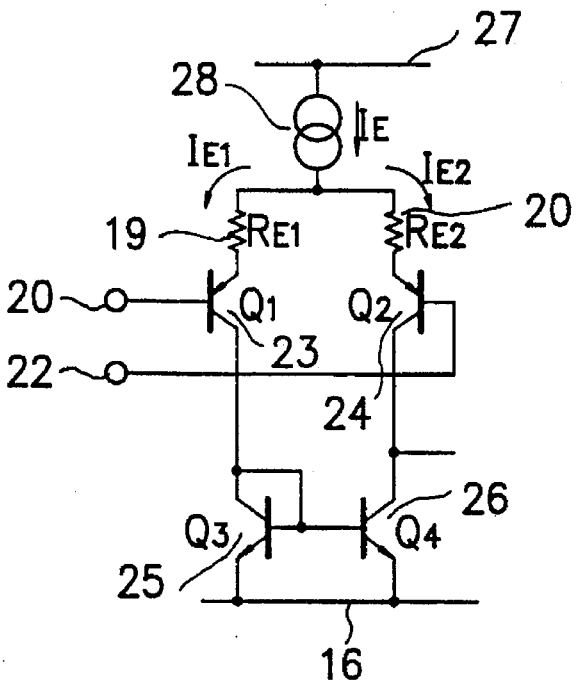
FIG. 8 is a diagram showing an example of an input section of a comparator of FIG. 7.
Figure 9:
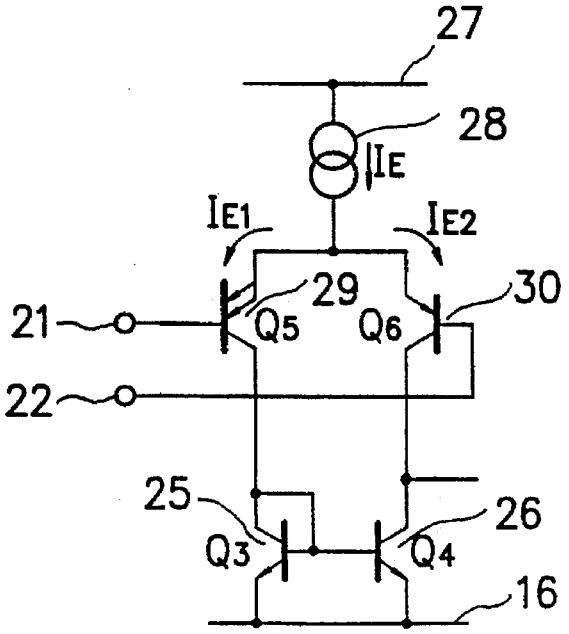
FIG. 9 is a diagram showing another example of an input section of a comparator of FIG. 7.

The other operations are the same as for the circuit of FIG. 5. In regard to the offset voltage 18 ($V_{os}$), FIGS. 8 and 9 show circuit examples of generating $V_{os}$. In FIG. 8, there are provided differential transistors 23 and 24 respectively have emitter resistors 19 and 20 having mutually different resistance values $R_{E1}$ and $R_{E2}$, thereby creating the offset voltage $V_{os}$. On the other hand, in the configuration of FIG. 9, the emitter size varies between the transistors 29 and 30 to generate $V_{os}$.

Figure 1:
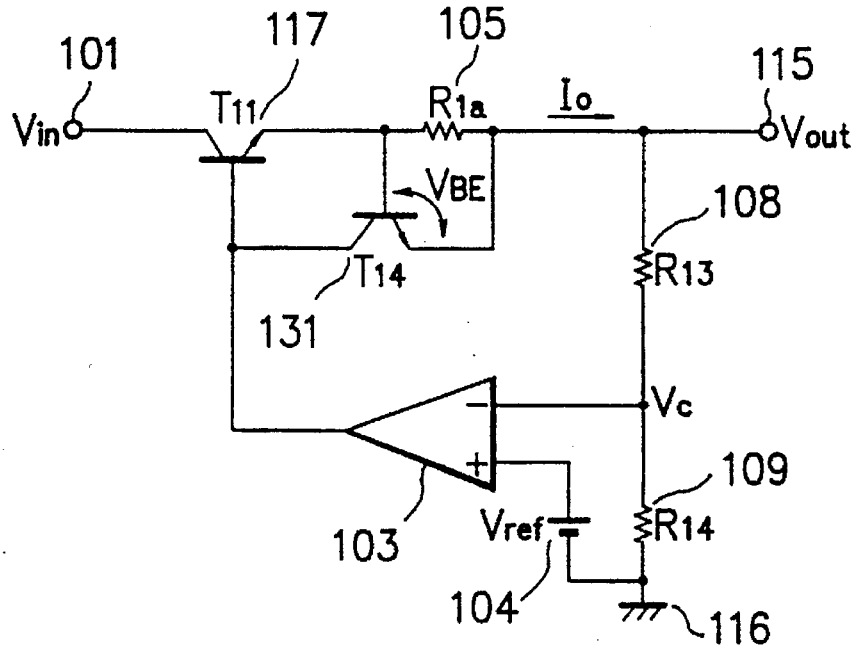
FIG. 1 PRIOR ART
FIG. 1 is a schematic diagram showing the configuration of a regulated power supply circuit of the prior art.
Figure 2:
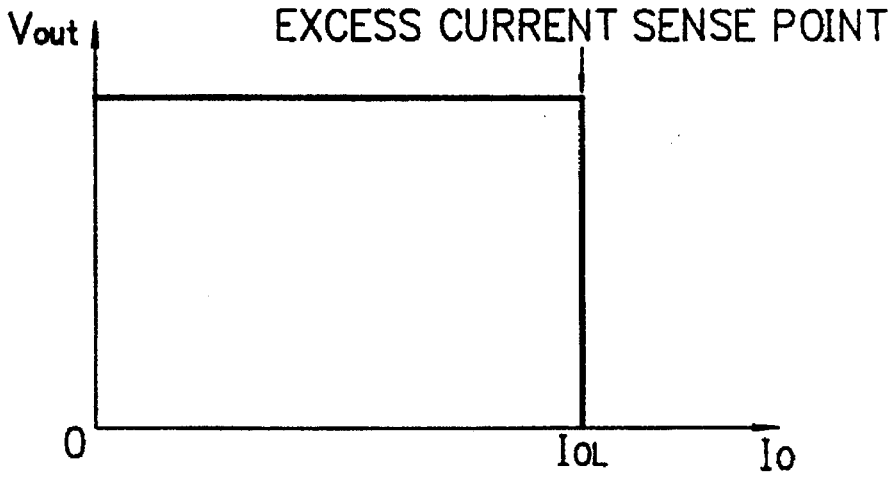
FIG. 2 PRIOR ART
FIG. 2 is a graph showing a characteristic of the circuit of FIG. 1.
Figure 3:
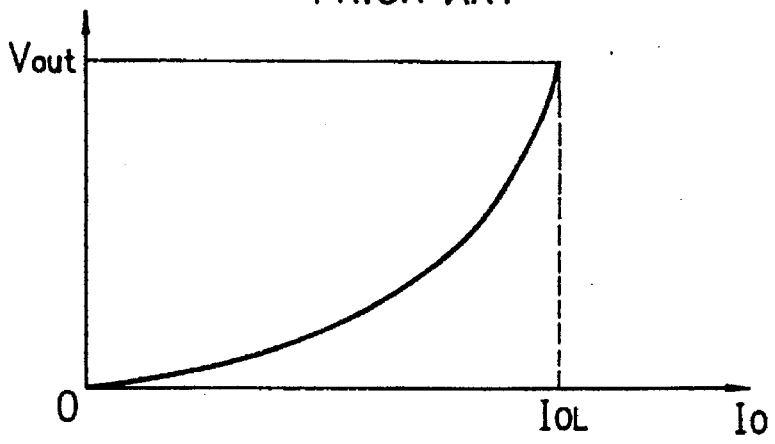
FIG. 3 PRIOR ART
FIG. 3 is a graph showing a "J characteristic curve" of a regulated power supply circuit of the prior art.
Figure 4:
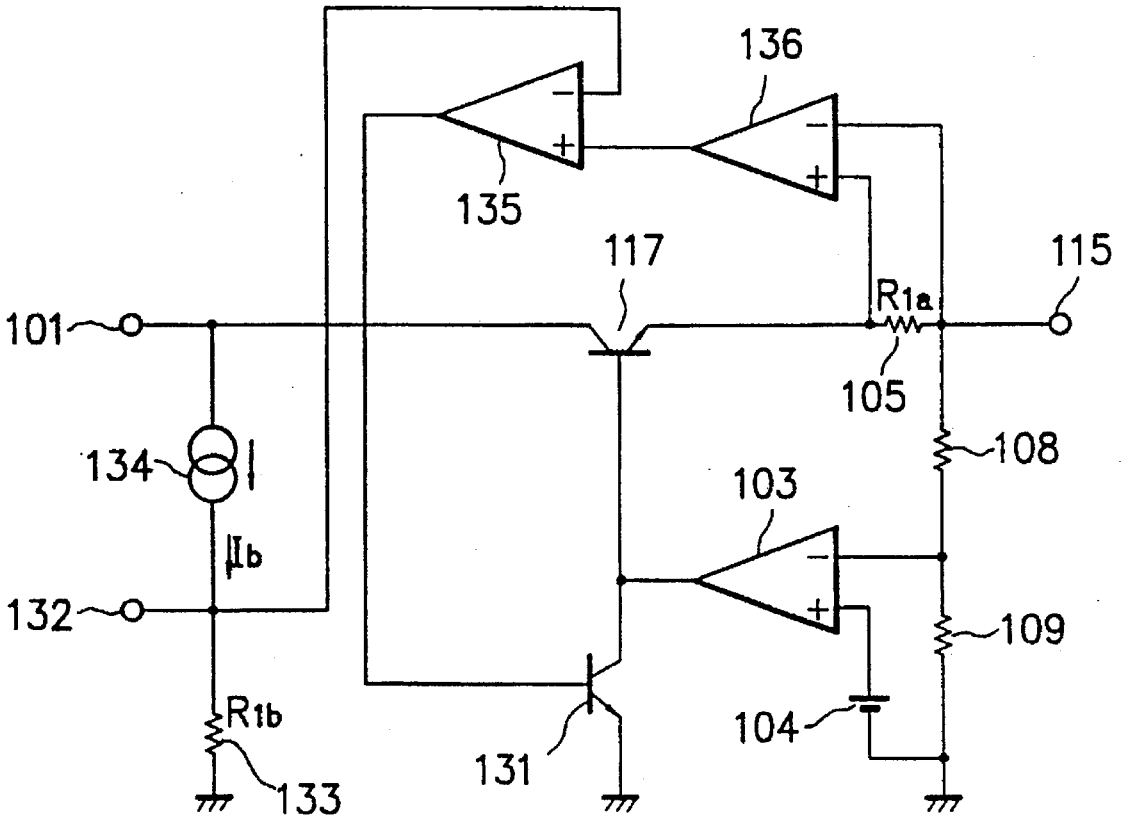
FIG. 4 PRIOR ART
FIG. 4 is a diagram schematically showing the configuration of another example of a regulated power supply circuit of the prior art.
Figure 6:
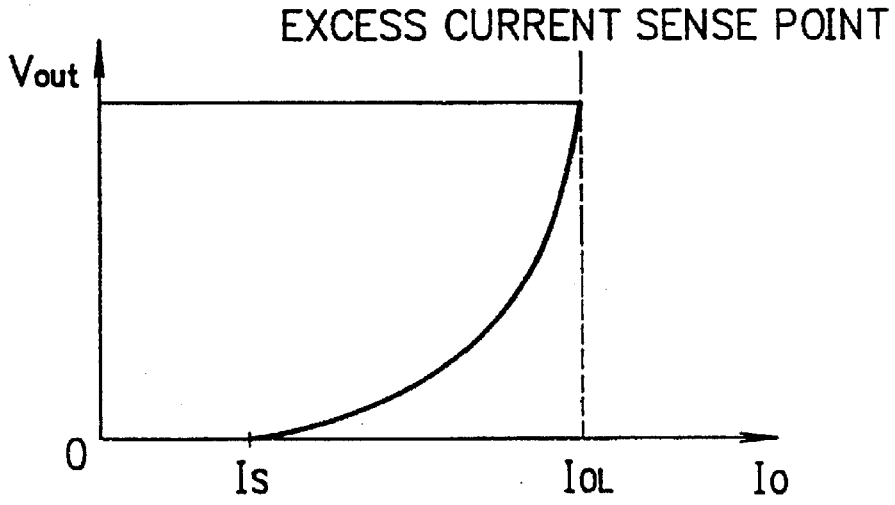
FIG. 6 is a graph showing a characteristic curve related to a relationship between an output voltage $V_{out}$ and an output current $I_o$ the circuit of FIG. 5.
Figure 7:
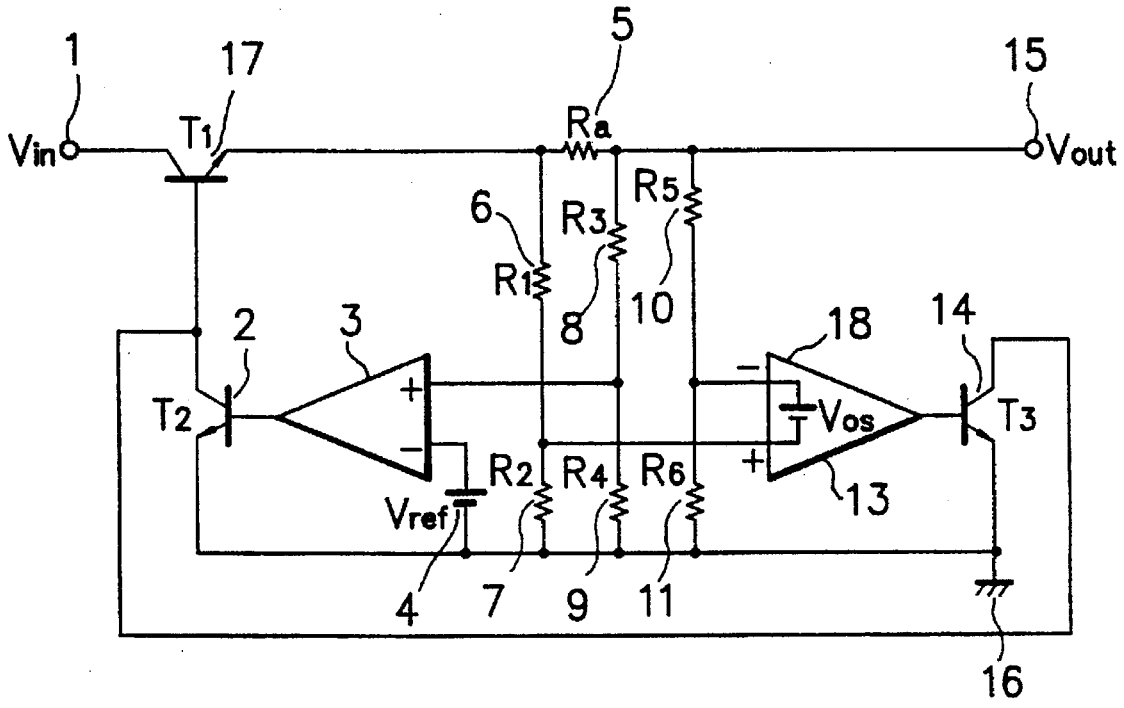
FIG. 7 is a schematic diagram showing another embodiment of the configuration of a regulated power supply circuit in accordance with the present invention.

The regulated power source circuit having the offset voltage of FIGS. 5 and 7 develops a characteristic curve showing a relationship between the output voltage $V_{out}$ and the output current $I_o$ as shown in FIG. 6. In the characteristic curve, there does not appear the disadvantage in which, $I_o$ is 0 for $V_{out}$=0 V (grounded state), which has been the case with the prior art of FIG. 3. This consequently solves the problem that the constant-voltage power circuit is not activated when $V_{1n}$ is inputted to the power source circuit.

As described above, in accordance with the present invention, it is possible to separately set the output current at the excess current sense point and in the grounded state of the output terminal. This minimizes the power consumption of the output-stage transistor in the grounded state and advantageously prevents heat generation and destruction of the regulated power supply circuit due to abnormality of the output terminal.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A regulated power supply circuit for adjusting an output current when an output terminal of the circuit is grounded, the circuit comprising:

current control means, disposed between an input terminal of the circuit and said output terminal and provided with two control input terminals, for controlling a current flowing through said input and output terminals of the circuit;

current sense means, inserted between a downstream end of said current control means and said output terminal, for sensing said current and supplying a resultant signal to a first one of said two control terminals: and voltage sense means for comparing a voltage between said output terminal of said circuit and a ground potential (GND) with a reference voltage and supplying an error signal to a second one of said two control input terminals, wherein said current sense means includes comparator means for sensing said current as a voltage applied to input terminals thereof; and the circuit further comprises a current source for causing the current to flow through a circuit including one of said input terminals of said comparator means so that the potential difference between said input terminals of said comparator means does not become zero even when the output current of the regulated power supply circuit is equal to zero.

2. A regulated power supply circuit which permits an adjustment of output current when an output terminal of the circuit is grounded, the circuit comprising:

current control means, disposed between an input terminal of the circuit and said output terminal and provided with two control input terminals, for controlling a current flowing through said input and output terminals of the circuit:

current sense means, inserted between a downstream end of said current control means and said output terminal, for sensing said current and supplying a resultant signal to a first one of said two control terminals; and voltage sense means for comparing a voltage between said output terminal of said circuit and a ground potential (GND) with a reference voltage and supplying an error signal to a second one of said two control input terminals, wherein:

said current sense means includes comparator means for sensing said current as a voltage applied to input terminals thereof; and said comparator means includes bias means for providing said input terminals of said current sense means with a bias voltage so that the potential difference between said input terminals of said comparator means does not become zero even when the output current of the regulated power supply circuit is equal to zero.

3. A regulated power supply circuit comprising:

current control means disposed between an input terminal and an output terminal, said current control means having a control terminal;

current sense means arranged between said output terminal and an output terminal of said current control means, said current sense means having a sense terminal; and voltage sense means for sensing a voltage between an output terminal of said current control means and a ground potential (GND), said voltage sense means having a sense terminal, said sense terminal of said current sense means, said sense terminal of said voltage sense means, and said control terminal of said current control means being connected to each other, wherein a predetermined bias current flows through said current control means when said output terminal is grounded to the GND potential.

* * * * *